US005442925A

United States Patent [19]

Agrawal et al.

[11] Patent Number: 5,442,925

[45] Date of Patent: Aug. 22, 1995

[54] PROCESS FOR THE CRYOGENIC DISTILLATION OF AN AIR FEED TO PRODUCE A LOW TO MEDIUM PURITY OXYGEN PRODUCT USING A SINGLE DISTILLATION COLUMN SYSTEM

[75] Inventors: Rakesh Agrawal; Leigh A. Stapf, both of Emmaus; Donald W. Woodward, New Tripoli, all of Pa.

[73] Assignee: Air Products and Chemicals, Inc., Allentown, Pa.

[21] Appl. No.: 259,086

[22] Filed: Jun. 13, 1994

[51] Int. Cl.[6] ..... F25J 3/02

[52] U.S. Cl. ..... 62/24; 62/39

[58] Field of Search ..... 62/24, 39

[56] References Cited

U.S. PATENT DOCUMENTS 4,382,366 5/1983 Gaumer ..... 62/31
4,566,887 1/1986 Openshaw ..... 62/37
4,707,994 11/1987 Shenoy et al. ..... 62/11
5,363,657 11/1994 Naumovitz ..... 62/39

*Primary Examiner*—Ronald C. Capossela
*Attorney, Agent, or Firm*—Robert J. Wolff

[57] ABSTRACT

A process is set forth for the cryogenic distillation of an air feed to produce a low to medium purity oxygen product using a single distillation column system. The air feed is partially condensed into a crude liquid oxygen stream and a remaining nitrogen-enriched vapor stream by boiling the liquid phase at the bottom of the distillation column. The pressure of the crude liquid oxygen stream is reduced and the nitrogen-enriched vapor stream is subsequently condensed against it to provide reflux to the top of the distillation column. The low to medium purity oxygen product (oxygen concentration between 65% and 99%) is withdrawn from the bottom of the distillation column as liquid, vapor or a combination of both.

7 Claims, 3 Drawing Sheets

PROCESS FOR THE CRYOGENIC DISTILLATION OF AN AIR FEED TO PRODUCE A LOW TO MEDIUM PURITY OXYGEN PRODUCT USING A SINGLE DISTILLATION COLUMN SYSTEM

FIELD OF THE INVENTION

The present invention relates to a process for the cryogenic distillation of an air feed to produce a low to medium purity oxygen product using a single distillation column system.

BACKGROUND OF THE INVENTION

A process for the cryogenic distillation of an air feed to produce a low to medium purity oxygen product using a single distillation column system is taught in the art. Specifically. U.S. Pat. No. 4,382,366 by Gaumer and U.S. Pat. No. 4,707,994 by Shenoy et al. teach such a process.

A key feature in both Gaumer and Shenoy are the methods used to provide (1) reboil to the bottom of the distillation column and (2) reflux to the top of the distillation column. In both Gaumer and Shenoy, reboil is provided by heat exchanging pressurized air feed against the liquid phase at the bottom of the distillation column in order to at least partially condense the air feed and at least partially reboil the liquid phase. In Gaumer, the resulting condensed feed air is used directly as reflux. In Shenoy, the resulting condensed feed air is indirectly used to provide reflux by first reducing its pressure across a valve and subsequently heat exchanging it against the vapor phase at the top of the distillation column in order to partially condense the vapor phase. The condensed vapor phase is then used as reflux.

There is a concern with Gaumer and Shenoy, however, in that the above reflux methods may not be the most efficient way of providing reflux to the single distillation column system. It is an object of the present invention to more efficiently provide reflux to the single distillation column system and thereby more efficiently produce the low to medium purity oxygen product.

SUMMARY OF THE INVENTION

The present invention is a process for the cryogenic distillation of an air feed to produce a low to medium purity oxygen product using a single distillation column system. The air feed is partially condensed into a crude liquid oxygen stream and a remaining nitrogen-enriched vapor stream by boiling the liquid phase at the bottom of the distillation column. The pressure of the crude liquid oxygen stream is reduced and the nitrogen-enriched vapor stream is subsequently condensed against it to provide reflux to the top of the distillation column. The low to medium purity oxygen product (oxygen concentration between 65% and 99%) is withdrawn from the bottom of the distillation column as liquid, vapor or a combination of both.

DETAILED DESCRIPTION OF THE INVENTION

Figure 1:
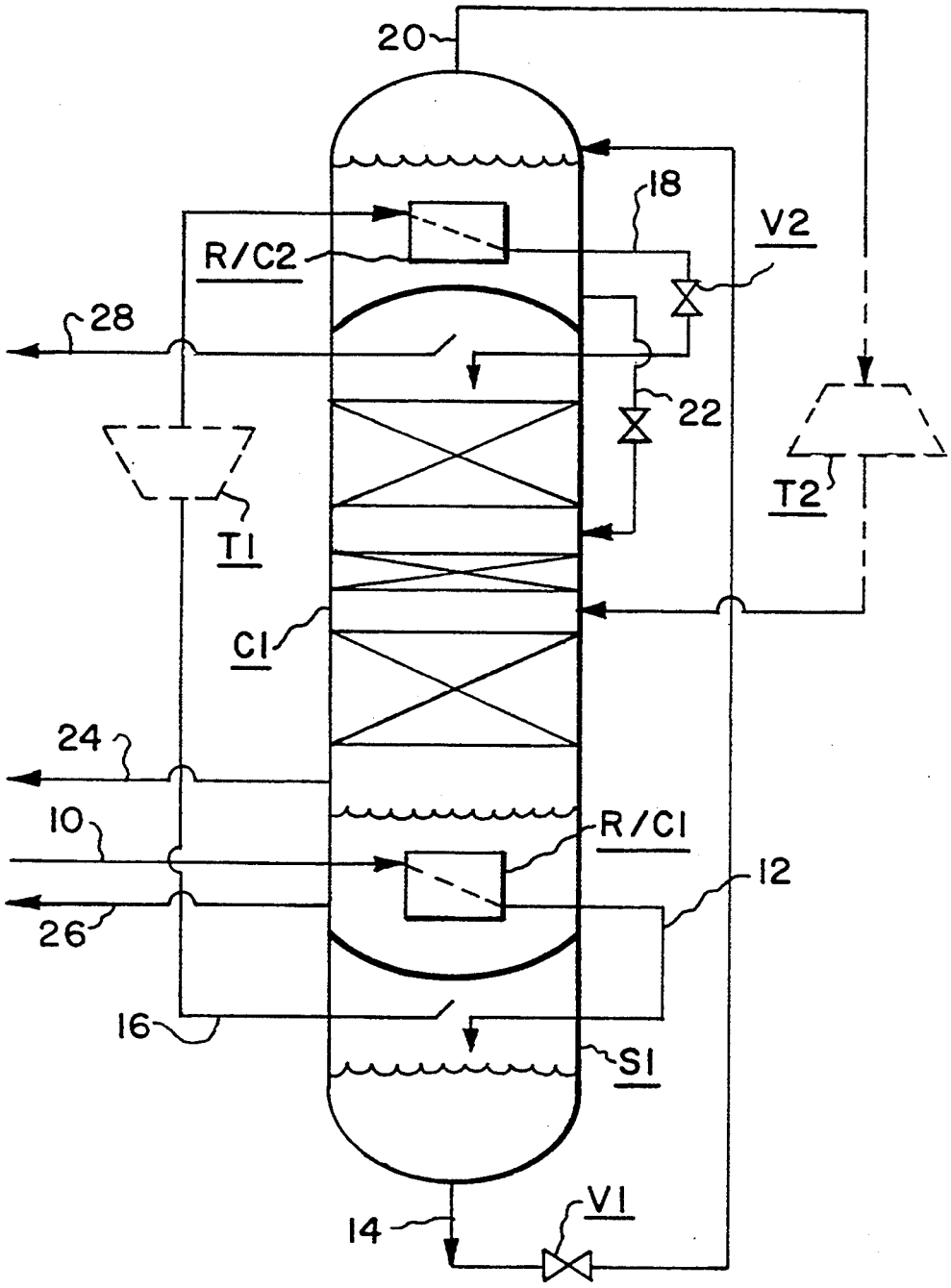
FIG. 1 is a schematic diagram of one embodiment of the present invention.

The process of the present invention is best illustrated with reference to a specific embodiment thereof such as the embodiment depicted in FIG. 1. Referring now to FIG. 1, the process begins with an air feed (stream 10) which has been compressed to an elevated pressure, cleaned of impurities which will freeze out at cryogenic temperatures and cooled to near its dew point. The compression of the feed stream is typically performed in multiple stages with interstage cooling against cooling water to a total pressure between about 50 and 70 psia. The cleaning of impurities which will freeze out at cryogenic temperatures (such as water and carbon dioxide) is typically performed by a process which incorporates an adsorption mole sieve bed. The cooling of the air feed down to its dewpoint is typically performed by heat exchanging the pressurized air feed in a front end main heat exchanger against the gaseous product streams which are produced from the process at cryogenic temperatures.

At least a portion of the air feed is heat exchanged in a first reboiler/condenser (R/C 1) against the liquid phase at the bottom of single distillation column C1. The purpose of this heat exchange is to:

(i) partially condense the air feed into a crude liquid oxygen stream (stream 14) and a remaining nitrogen-enriched vapor stream (stream 16); and (ii) at least partially boil the liquid phase, thereby providing reboil to the bottom of the distillation column.

The ratio of the crude liquid oxygen stream to the remaining nitrogen-enriched vapor stream is typically around 1.5. As shown in FIG. 1, the partially condensed air feed (stream 12) is separated into streams 14 and 16 in separator S1 located beneath the single distillation column.

The pressure of the crude liquid oxygen stream is reduced across valve V1 and subsequently heat exchanged in a second reboiler/condenser (R/C 2) against the nitrogen-enriched vapor stream. The purpose of this heat exchange is to:

(i) completely condense the nitrogen-enriched stream; and (ii) at least partially boil the crude liquid oxygen stream into a vapor portion (stream 20) and a remaining liquid portion (stream 22).

These liquid and vapor portions are returned to a suitable location in the distillation column (ie a location where the composition in the column is similar to the composition of the streams being returned). Although not shown in FIG. 1, the liquid and vapor portions can be returned to the same location.

The pressure of the condensed nitrogen-enriched stream (stream 18) is reduced across valve V2 and subsequently fed to the top of the distillation column, thereby providing reflux to the top of the distillation column.

The low to medium purity oxygen product (typical oxygen concentration: 65–99%) is withdrawn from the bottom of the distillation column as liquid (stream 26) or, more typically, vapor (stream 24) or a combination of both. As shown in FIG. 1, a gaseous nitrogen product (stream 28) can also be withdrawn from the top of the distillation column.

As shown by the dotted lines in FIG. 1, nitrogen-enriched stream 16 and/or vapor portion 20 can be expanded in turbo-expanders T1 and T2 respectively in order to provide a portion of the needed refrigeration for the process. In this scenario, it may be advantageous to partially warm the stream(s) at issue in the main heat exchanger prior to expansion. One advantage of expanding the nitrogen-enriched stream 16 vis-a-vis the vapor portion 20 in FIG. 1 is reduced flash loss when stream 18 is flashed across valve V2 to provide reflux. This is because expanding stream 16 prior to its condensation will lower the condensation temperature for stream 16 which in turn makes liquid stream 18 colder which in turn will reduce the flash loss when liquid stream 18 is flashed across valve V2.

As shown in FIG. 1, the heat exchanges in R/C 1 and R/C 2 are performed, respectively, in the sump of the distillation column and on the top of the distillation column. Optionally, these heat exchanges can be performed in the front end main heat exchanger.

Figure 2:
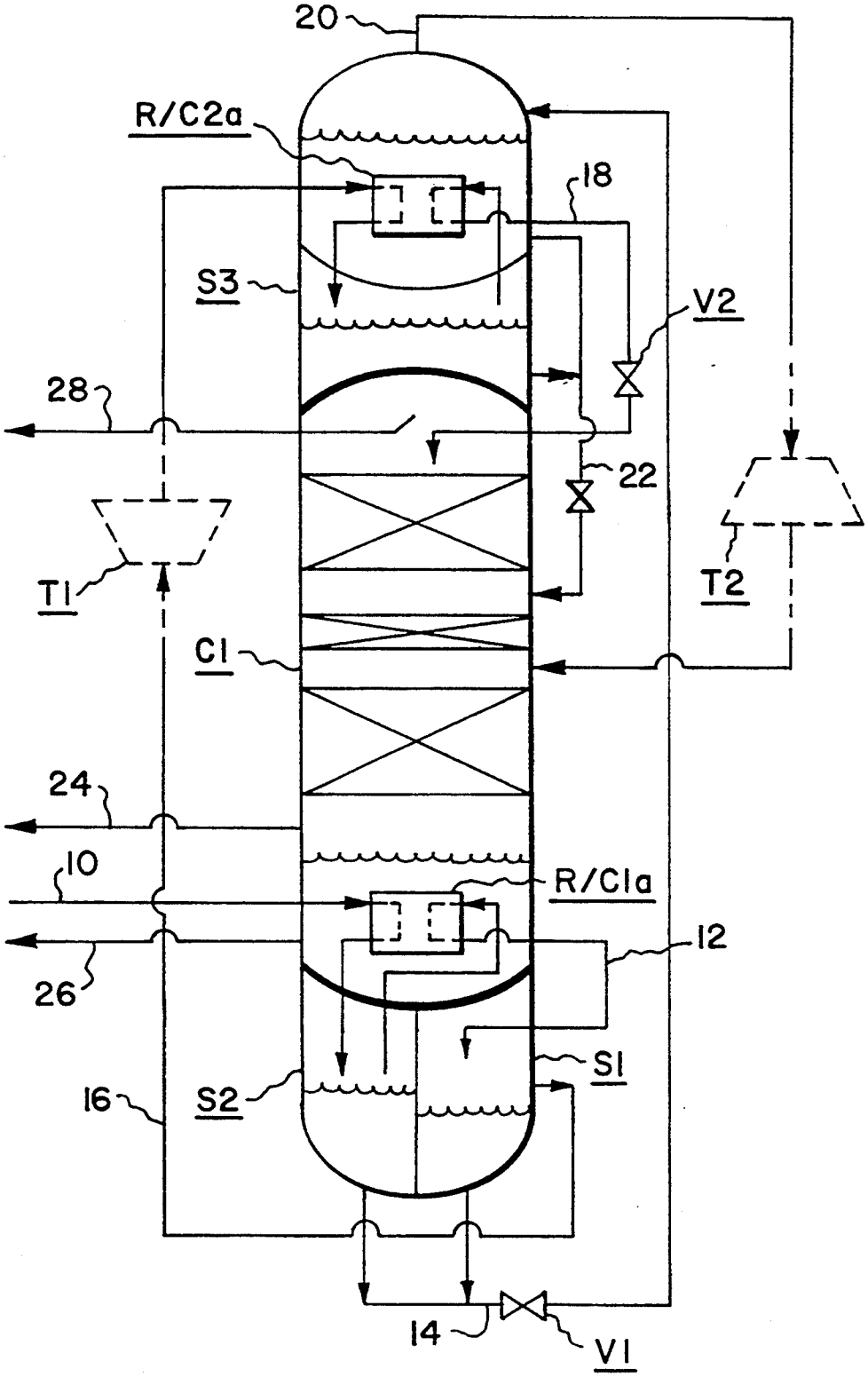
FIG. 2 is a schematic diagram of a second embodiment of the present invention.
Figure 3:
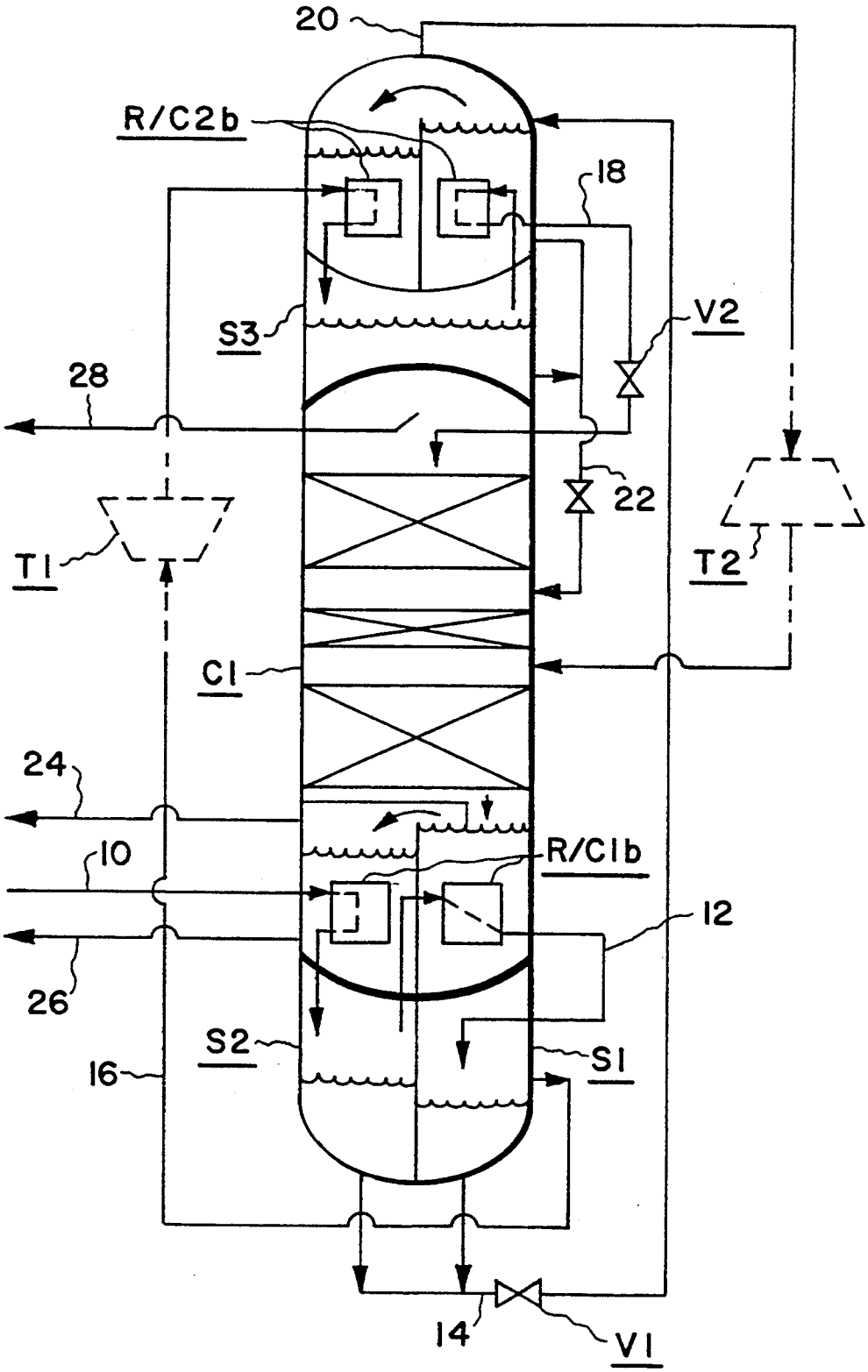
FIG. 3 is a schematic diagram of a third embodiment of the present invention.

It should be noted that the partial condensation of the air feed (stream 10) and/or the complete condensation of the nitrogen-enriched vapor stream (stream 16) can be performed in a plurality of steps in order to provide a more nitrogen-rich reflux (stream 18) to the distillation column and thereby increase the oxygen recovery of the process at low to medium purity levels. FIG. 2 illustrates this concept. FIG. 2 is similar to FIG. 1 (common streams and equipment are identified by the same number) except that the partial condensation of the air feed (stream 10) and the complete condensation of the nitrogen-enriched vapor stream (stream 16) are each performed in two steps. The two step partial condensation of the air feed is illustrated by reboiler/condenser R/C 1*a* and additional separator S2 in FIG. 2 while the two step complete condensation of the nitrogen-enriched vapor stream is illustrated by reboiler/condenser R/C 2*a* and additional separator S3 in FIG. 2. Both the liquid from the initial condensation step of the air feed which collects in separator S2 and the liquid from the initial condensation step of the nitrogen-enriched vapor stream which collects in separator S3 are fed to suitable locations in the single distillation column. In FIG. 2, the liquid which collects in separator S2 is removed as a portion of the crude liquid oxygen in stream 14 while the liquid which collects in separator S3 is removed as a portion of stream 22.

Where multiple step condensation is used as described above, multiple reboiler/condensers may be used to increase the energy efficiency as illustrated in FIG. 3. FIG. 3 is similar to FIG. 2 (common streams and equipment are identified by the same number) except multiple reboiler/condensers R/C 1*b* and R/C 2*b* are used in place of single reboiler/condensers R/C 1*a* and R/C 2*a* respectively. Another option would be to replace the single reboiler/condensers with dephlegmators or refluxing heat exchangers. A refluxing heat exchanger would be especially suited for providing reboil to the bottom of the distillation column. In this scenario, the stream in the boiling passages of the refluxing heat exchanger would be the oxygen-rich liquid phase at the bottom of the column while the stream in the condensing side of the refluxing heat exchanger would be the air feed. As the air feed moves up in the condensing passages, the vapor phase is more enriched in nitrogen and this will enable one to obtain a more nitrogen-rich reflux for the top of the column.

Computer simulations of the present invention have demonstrated that its energy efficiency is similar to the classical high pressure/low pressure column arrangement but with capital savings of about 5–10% for cycles producing 200 tons/day of low to medium purity oxygen. For smaller plants, the percentage of capital saved is higher while for larger plants, the percentage of capital saved is lower.

The present invention has been described with reference to specific embodiments thereof. These embodiments should not be seen as a limitation of the scope of the present invention; the scope of such being ascertained by the following claims.

We claim:

1. A process for the cryogenic distillation of an air feed to produce a low to medium purity oxygen product using a single distillation column system comprising the steps of:

(a) heat exchanging at least a portion of the air feed against the liquid phase at the bottom of the distillation column in order to:
  (i) partially condense the air feed into a crude liquid oxygen stream and a remaining nitrogen-enriched vapor stream; and
  (ii) at least partially boil the liquid phase, thereby providing reboil to the bottom of the distillation column;

(b) reducing the pressure of the crude liquid oxygen stream and subsequently heat exchanging it against the nitrogen-enriched vapor stream in order to:
  (i) completely condense the nitrogen-enriched stream; and
  (ii) at least partially boil the crude liquid oxygen stream into a vapor portion and a remaining liquid portion;

(c) reducing the pressure of the condensed nitrogen-enriched stream and subsequently feeding it to the top of the distillation column, thereby providing reflux to the top of the distillation column;

(d) feeding the liquid and vapor portions from step (b)(ii) to an intermediate section of the distillation column; and (e) withdrawing the low to medium purity oxygen product from the bottom of the distillation column.

2. The process of claim 1 wherein the ratio of the crude liquid oxygen stream to the nitrogen-enriched vapor stream in the partially condensed air feed from step (a) is approximately 1.5.

3. The process of claim 2 wherein the low to medium purity oxygen product withdrawn in step (e) is withdrawn as liquid, vapor or a combination of both and has an oxygen concentration between 65% and 99%.

4. The process of claim 3 wherein a nitrogen product is withdrawn from the top of the distillation column.

5. The process of claim 4 wherein, in order to provide a portion of the refrigeration for the process:

(i) the nitrogen-enriched stream from step (a)(i) is expanded in a turbo-expander prior to heat exchanging it in step (b); and/or (ii) the vapor portion from step (b)(ii) is expanded in a turbo-expander prior to feeding it to the distillation column in step (d).

6. The process of claim 5 wherein, in order to provide a more nitrogen-rich reflux in step (c), the partial condensation of the air feed in step (a)(i) and/or the complete condensation of the nitrogen-enriched vapor stream in step (b)(i) is performed in a plurality of steps.

7. The process of claim 6 wherein the multiple step condensation of the air feed in step (a)(i) and/or the multiple step condensation of the nitrogen-enriched vapor stream in step (b)(i) is performed in multiple reboiler/condensers.

* * * * *